US006144249A

United States Patent [19]

Tse

[11] Patent Number: 6,144,249

[45] Date of Patent: Nov. 7, 2000

[54] CLOCK-REFERENCED SWITCHING BIAS CURRENT GENERATOR

[75] Inventor: Lawrence Tze-Leung Tse, San Jose, Calif.

[73] Assignee: Chrontel, Inc., San Jose, Calif.

[21] Appl. No.: 09/007,394

[22] Filed: Jan. 15, 1998

[51] Int. Cl.[7] ..... G05F 1/10

[52] U.S. Cl. ..... 327/539; 327/316; 323/316; 323/317

[58] Field of Search ..... 327/538, 539, 327/540, 541, 530–533, 315, 316; 323/312, 313, 316, 317

[56] References Cited

U.S. PATENT DOCUMENTS 4,851,719 7/1989 Hitomi ..... 327/58

5,247,241 9/1993 Ueda ..... 323/312

*Primary Examiner*—Timothy P. Callahan
*Assistant Examiner*—Minh Nguyen
*Attorney, Agent, or Firm*—Flehr Hohbach Test Albritton & Herbert LLP

[57] ABSTRACT

A clock-referenced switching bias current source is disclosed wherein an accurate bias current is established based on the charge dissipated by a switching capacitor over a predetermined period. The time period is established by a very accurate system clock. The value of the capacitor can be accurately selected with ±10%. By selecting a particular capacitance and frequency, a desired average bias current value is determined according to the amount of charge dissipated over the predetermined period. In different embodiments, the bias current source can be configured to provide a bandgap current that is temperature and/or process independent.

16 Claims, 8 Drawing Sheets

CLOCK-REFERENCED SWITCHING BIAS CURRENT GENERATOR

The present invention relates generally to bias current generators for generating a bias current. In particular it pertains to bias current generators that do not require an external reference resistor for generating an accurate bias current.

BACKGROUND OF THE INVENTION

The availability of a bias current source with an accurate and controllable absolute value in CMOS integrated circuits is highly desirable in a wide range of applications. Conventional techniques typically utilize an external resistor to define the value of the bias current. This requires the allocation of a dedicated package pin to connect to the external resistor, which is costly and inefficient. Accurate clock signals, on the other hand, are readily available in digital and mixed analog/digital integrated circuits.

Accordingly, it is an objective of the present invention to provide a bias current generator that generates an accurate bias current using the available clock signals as a reference. It is yet another objective of the present invention to provide a clock-referenced switching bias current generator that is implemented in CMOS technology. It is a further objective of the present invention that the bias current generator satisfy different design goals, including tracking a bandgap voltage to produce an accurate, temperature-insensitive bandgap bias current and generating an anti-process bias current (e.g., a larger current for a circuit fabricated at a slow process corner).

SUMMARY OF THE INVENTION

In summary, the present invention is a bias current generator that provides an accurate bias current without the need for external components. In particular, the present invention is a bias current generator that derives an accurate bias current using a switching capacitor controlled by a clock signal. The capacitor is selected to dissipate a particular average amount of charge. The particular average amount of charge dissipated over an operating period is the same as a desired value of the bias current. The clock signal used to control the capacitor has an accurate frequency whose inverse corresponds to the operating period.

A preferred embodiment of the bias current generator includes first, second and third capacitors, first, second and third switches, an amplifier and a transistor. The first capacitor is connected in parallel with the first switch between a first internal node and a supply voltage node. The first switch is controlled by a first clock signal. The second switch is controlled by a second clock signal at the same frequency as, and non-overlapping with, the first clock signal. The input and output of the second switch are coupled respectively to the first internal node and a second internal node. The second capacitor is coupled between the second internal node and the supply voltage node. The third switch is controlled by the first clock signal and has an input and output of the second switch being coupled respectively to the second internal node and a third internal node. The third capacitor is coupled between the third internal node and the supply voltage node and holds the voltage at the third internal node constant during one period of the first clock signal. The amplifier has a first input coupled to the third internal node, a second input coupled to a reference (VREF)voltage node, and an output corresponding to the difference between the signals at the first and second inputs. The transistor has a gate coupled to the output of the amplifier, a drain coupled to the first internal node, and a source coupled to a ground node.

In the preferred embodiment:

(1) when the first clock signal is active, the first capacitor is discharged and the voltage at the first internal node is at the supply voltage;

(2) when the second clock signal is active, the voltage at the first internal node ramps down from the supply voltage;

(3) when the second clock signal makes an active to inactive transition, the voltage at the first node is sampled by the second capacitor onto the second internal node; and (4) when the first clock signal makes an inactive to active transition, the voltage at the second internal node is coupled to the third internal node.

Thus, the negative feedback loop including the capacitors and switches interacts with the amplifier to control the gate voltage of and thus the drain current drawn by the transistor. This causes the voltage at the first internal node to ramp down from the supply voltage to the reference voltage by the time the second clock signal makes an active to inactive transition. The drain current is identical to the bias current.

In the preferred embodiment, the drain current IDM1 through the transistor required to cause the voltage at the first internal node to ramp down from the supply voltage VDD to the reference voltage VREF during the active period of the first clock signal is given by the following expression:

$$IDM1=IOUT=(2fc)(C1)(VDD-VREF),$$

where IOUT represents the bias current established by the bias current generator, fc represents the frequency of the first clock signal, and C1 represents the capacitance of the first capacitor.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
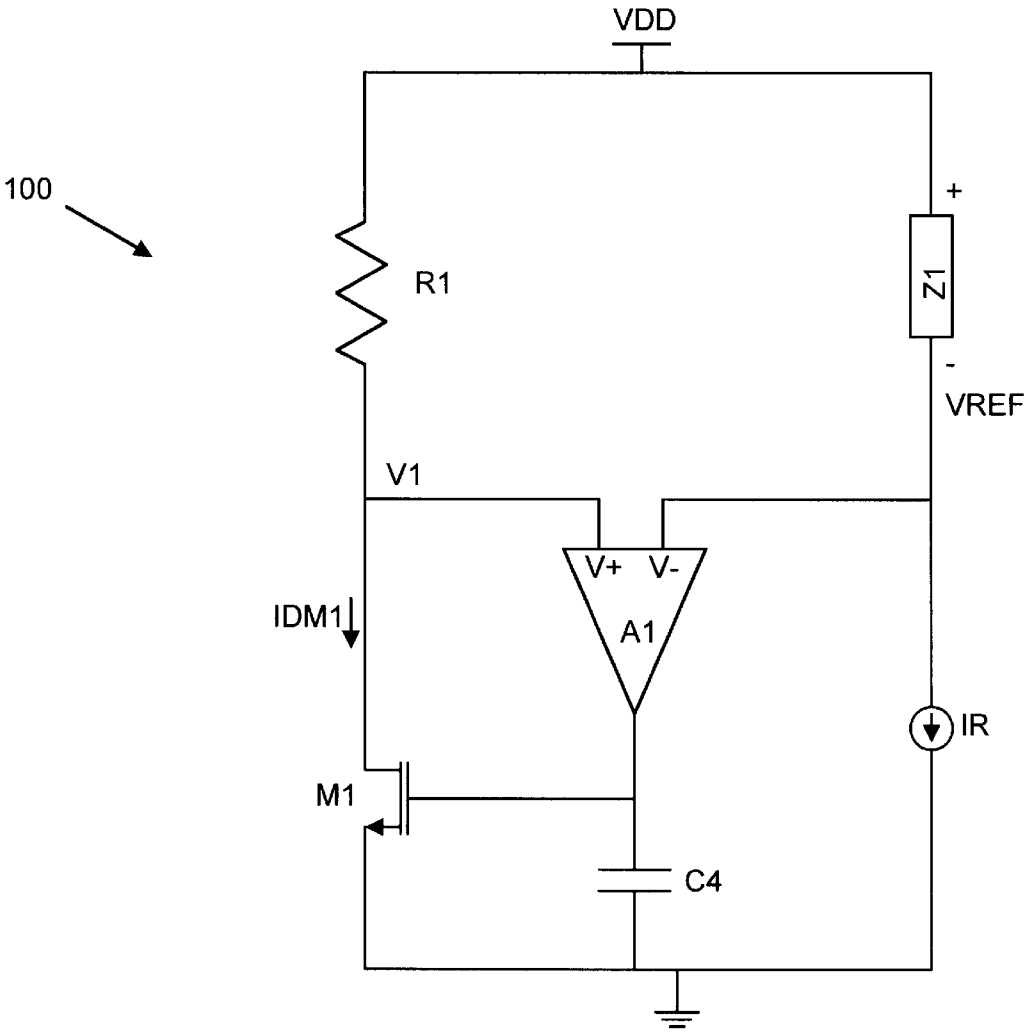
FIG. 1 is a schematic showing a continuous time implementation of a simple bias current generator in accordance with the present invention.

Referring to FIG. 1, there is shown a continuous time implementation of a simple bias current generator 100. A reference current source IR forces a reference current through an impedance Z1 to generate a particular voltage drop (VDD−VREF) across the impedance Z1 from the supply voltage VDD to a reference voltage VREF. An amplifier A1, an NMOS transistor M1 and a resistor R1 form a negative feedback loop. The loop gain of this feedback loop forces a voltage V1 to have the same value as the reference voltage VREF. A capacitor C4 is used as a filtering capacitor and also used to ensure stability of the feedback loop. As a result of the feedback mechanism, the current IDM1 running through the transistor M1 is thus IDM1=(VDD−VREF)/R1. The voltage (VDD−VREF) across the impedance Z1 can be made to be a bandgap voltage. Hence, its absolute value and its temperature dependency can be very well controlled. Unfortunately, the absolute value of an on-chip resistor R1 is typically in the range of ±25% and its temperature coefficient is in the range of 800 ppm to 3000 ppm. Therefore, an accurate current IDM1 cannot be generated easily.

Figure 2A:
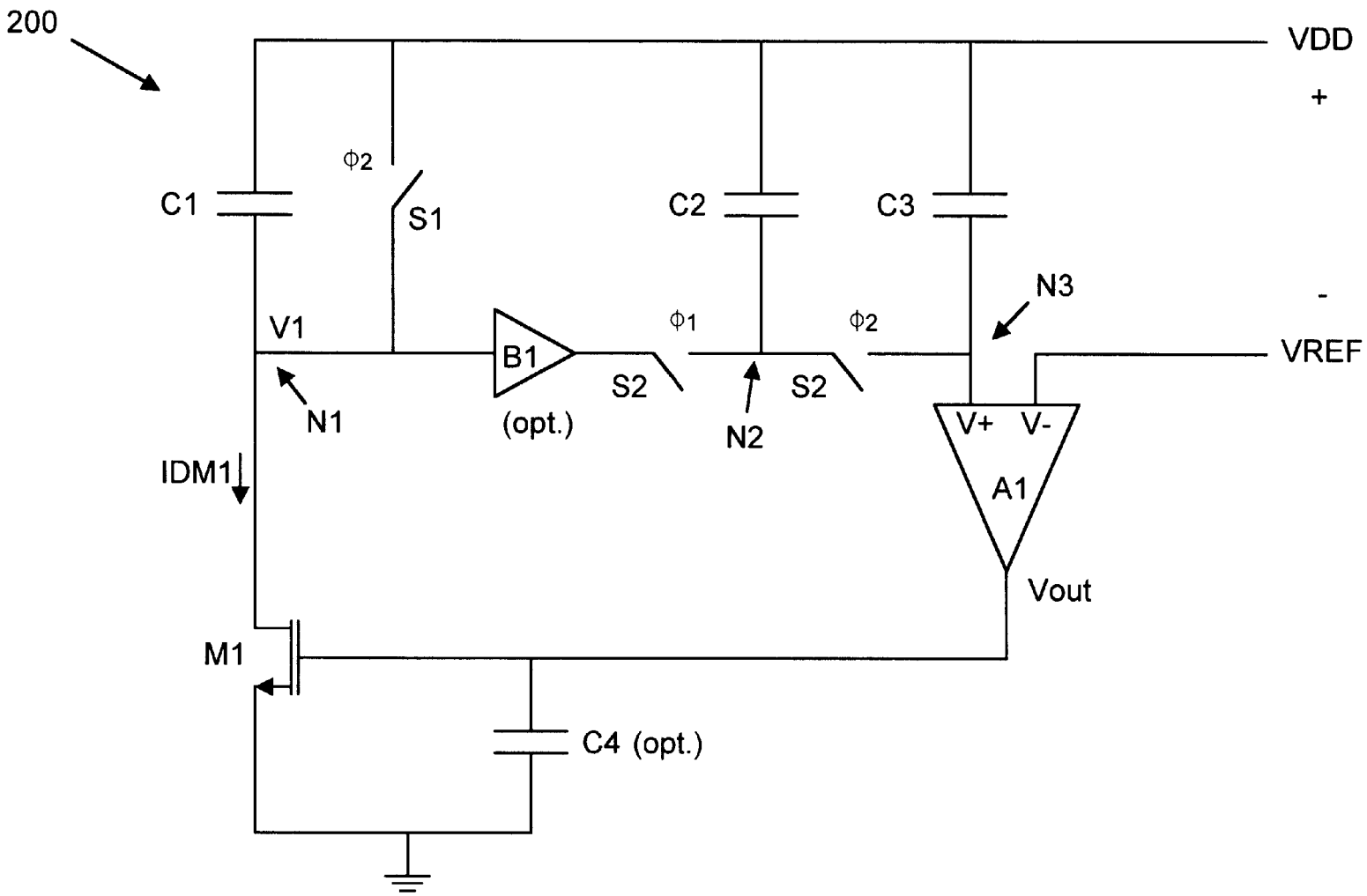
FIG. 2A is a simplified schematic of a clock-referenced switching bias current generator in accordance with the present invention.

Referring to FIG. 2A, there is shown a simplified schematic of a clock-referenced switching bias current generator 200 in accordance with the present invention. The bias current generator 200 includes four capacitors C1, C2, C3, C4; three switches S1, S2 and S3; a transistor M1 and an amplifier A1. Inputs to the bias current generator 200 include a positive supply voltage VDD, a reference voltage VREF, and two clock signals ϕ1 and ϕ2.

The capacitor C1 is connected in parallel with the switch S1 between a first internal node N1 and a supply voltage VDD node. The first switch S1 is controlled by the clock signal ϕ2. The second switch S2 is controlled by the clock signal ϕ1, which is at the same frequency fc as and non-overlapping with the clock signal ϕ2. The input and output of the switch S2 are coupled respectively to the first internal node N1 and a second internal node N2. The capacitor C2 is coupled between the second internal node N2 and the supply voltage VDD node. The switch S3 is controlled by the clock signal ϕ2 and has an input and output coupled respectively to the second internal node N2 and a third internal node N3. The capacitor C3 is coupled between the third internal node N3 and the supply voltage VDD node. The switches S2, S3, C2 and C3 implement an equivalent of an RC filter in a discrete-time sample-data system to smooth out the saw-tooth waveform due to the charging and discharging of capacitor C1. The amplifier A1 has a first input V+ coupled to the third internal node N3, a second input V− coupled to a reference voltage VREF node, and an output VOUT corresponding to the difference between the signals at the first and second inputs V+ and V− multiplied by the gain of the amplifier A1. The transistor M1 has a gate coupled to the output of the amplifier A1, a drain coupled to the first internal node N1, and a source coupled to a ground node. The action of the negative feedback loop along with the amplifier A1 forces the difference between the inputs V+ and V− of the amplifier A1 to approach zero (provided that the open-loop gain of the overall feedback loop is sufficiently large).

The bias current generator 200 can also include an optional buffer B1 and capacitor C4. The buffer B1 has an input coupled to the first switch S1 and an output coupled to the second switch S2. The capacitor C4 is coupled between the gate of the transistor M1 and the ground node. When present, the capacitor C4 provides compensation and filtering for the negative feedback loop.

The bias current generator 200 shown in FIG. 2A derives an accurate current IDM1 using a switching capacitor C1 selected to dissipate a defined average amount of charge over an operating period that is identical to one period 1/fc of the clock signalϕ2. The average amount of charge dissipated over the operating period determines the current IDM1. The present invention is able to provide a well-defined current IDM1 because the system clock signal ϕ2 that controls the discharge of the switching capacitor C1 is very accurate. The amplifier A1 ensures that the voltage V1 at the node N1 falls from the supply voltage VDD to the reference voltage VREF over the same operating period. This enables the current to be accurately defined according to the well-known relationship $$I = C\frac{dV}{dt}$$

between the time-derivative of voltage $$\frac{dV}{dt},$$

capacitance C, and current in a capacitor. The operation of the present invention is now described in reference to FIG. 2B, which shows voltage versus time plots of the clock signals ϕ1, ϕ2 and the voltage V1.

Figure 2B:
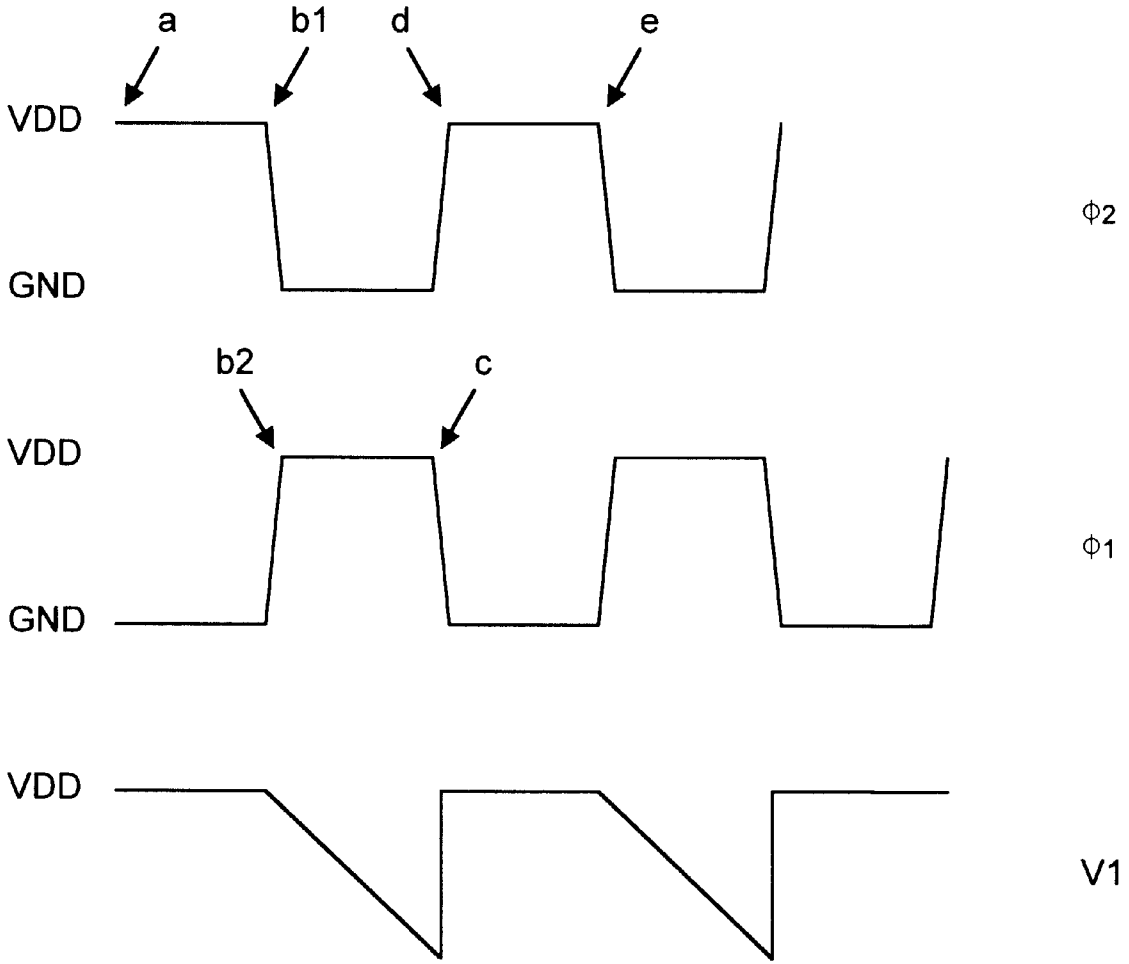
FIG. 2B shows voltage versus time plots of the clock signals $\phi$1, $\phi$2 and V1 that control the operation of the bias current generator of FIG. 2A.
Figure 2C:
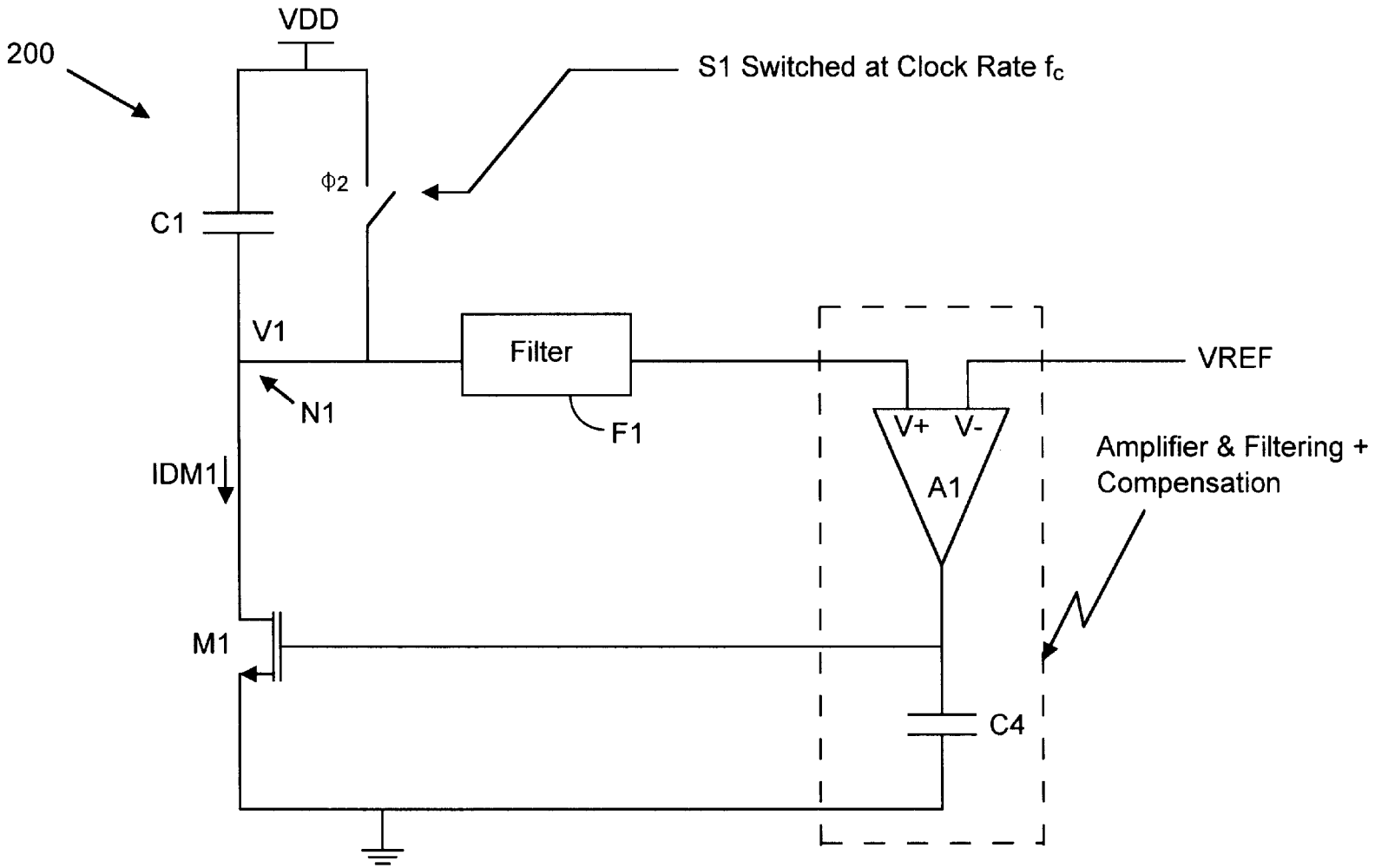
FIG. 2C is a high level schematic of the present invention, roughly corresponding to the bias current generator of FIG. 2A.

Referring to FIG. 2C, there is shown a high level schematic of the present invention, roughly corresponding to the preferred embodiment of FIG. 2A. The capacitor C1, switch S1, transistor M1, amplifier A1 and capacitor C4 correspond to the like numbered elements of FIGS. 1 and 2A. These elements are key components of the negative feedback loop that provides the control needed to generate the desired current IDM1. The filter F1 performs filtering at the V+ input of the amplifier A1 and can be implemented using any type of RC filtering circuit. In the preferred embodiment, shown in FIG. 2A, the functionality of the filter F1 is implemented with the switches S2 and S3 and the capacitors C2 and C3. The capacitor C4 is optional and plays a role in performing filtering at the gate of the transistor M1.

Referring to FIG. 2B, there are shown voltage versus time plots of the clock signals ϕ1 and ϕ2 that control the operation of the bias current generator 200 and of the resulting signal V1. When the clock signal ϕ2 is active (between points a and b1), the capacitor C1 is discharged and the voltage at the first internal node N1 is at the supply voltage VDD. When the clock signal ϕ1 is active (between points b2 and c), the voltage at the first internal node N1 ramps down from the supply voltage VDD. When the clock signal ϕ1 makes an active to inactive transition (at c), the voltage at the first internal node N1 is sampled by the capacitor C2 onto the second internal node N2. While the clock signal ϕ2 is active (between d and e), the voltage at the second internal node N2 is coupled to the third internal node N3. During these operations the negative feedback loop forces the inputs V+ and V− to be at the same potential, while the capacitor C3 holds the voltage V3 at the third internal node N3 constant after the loop has reached steady-state.

In order to have the inputs V+ and V− equal, the voltage V1 must equal the reference voltage VREF at the end (c) of the clock signal ϕ1 when the voltage at the output of the buffer B1 is sampled onto the capacitor C2. The magnitude of the current IDM1 through the transistor M1 that allows the voltage V1 to ramp down from the supply voltage VDD to the reference voltage VREF during the active period of the clock signal ϕ1 is therefore given by the following expression:

$$IDM1=IOUT=(2fc)(C1)(VDD-VREF) \quad \text{Eq. (1)}$$

where IOUT represents the bias current established by the bias current generator 200 and C1 represents the capacitance of the capacitor C1.

Thus, the feedback loop, by controlling the gate voltage of and the drain current IDM1 drawn by the transistor M1, causes the voltage V1 at the first internal node N1 to ramp down from the supply voltage VDD to the reference voltage VREF by the time the clock signal ϕ1 makes an active to inactive transition. The drain current IDM1 is identical to the bias current IOUT that is to be established by the present invention, as will be discussed shortly with reference to FIG. 3A. Note that the current IDM1 can be controlled or modified by changing the frequency of the clocks ϕ1 and ϕ2. Details of the preferred embodiment of the present invention are now described in reference to FIG. 3A.

Figure 3A:
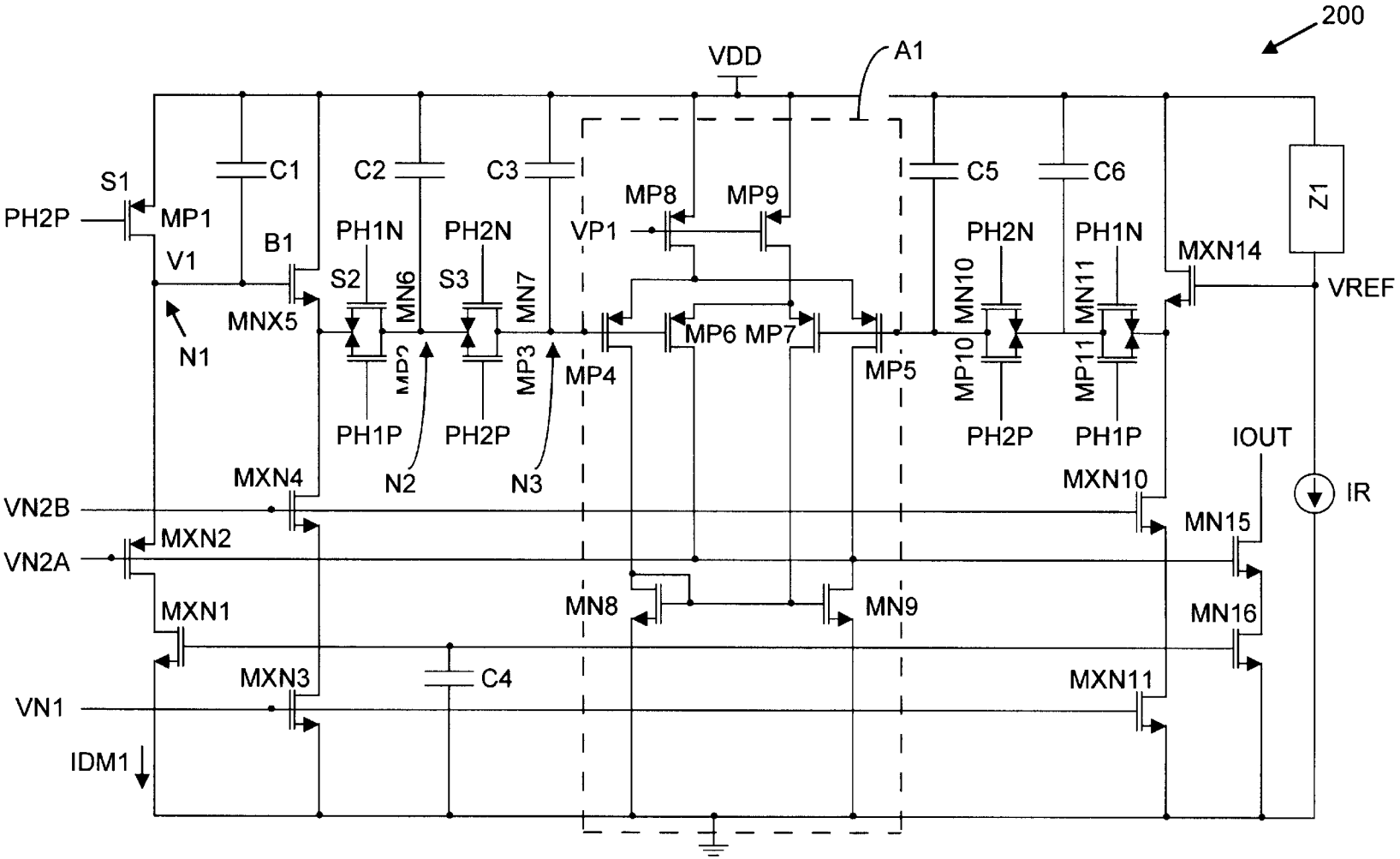
FIG. 3A is a detailed schematic of the bias current generator of FIG. 2A.

Referring to FIG. 3A, there is shown a detailed schematic of the clock-referenced switching bias current generator 200 of FIG. 2A. In the preferred embodiment, the amplifier A1 of FIG. 2A includes p-channel transistors MP4–MP9 and n-channel transistors MN8 and MN9. The switch S1 is implemented as a p-channel transistor MP1 and the buffer B1 is implemented as a n-channel transistor MNX5. The switches S2 and S3 are respectively implemented with n-channel/p-channel transistor pairs MN6/MP2 and MN7/MP3. To provide a fully differential structure, matched transistor pairs MN10/MP10 and MN11/MP11 are provided, corresponding to the input switches S2, S3, with capacitors C5 and C6 corresponding to the capacitors C2 and C3. This differential switching arrangement minimizes offsets due to charge injection, clock feedthrough, and transistor mismatches. An n-channel transistor MNX14 is provided to buffer the VREF signal in the same manner the transistor MNX5 buffers the V1 signal to provide a matched structure that accounts for input charge injection. Other circuit elements include an impedance Z1, a current source IR, and n-channel transistors MN15, MN16, M1, MXN2, MXN3, MXN4, MXN10 and MXN11.

Figure 3B:
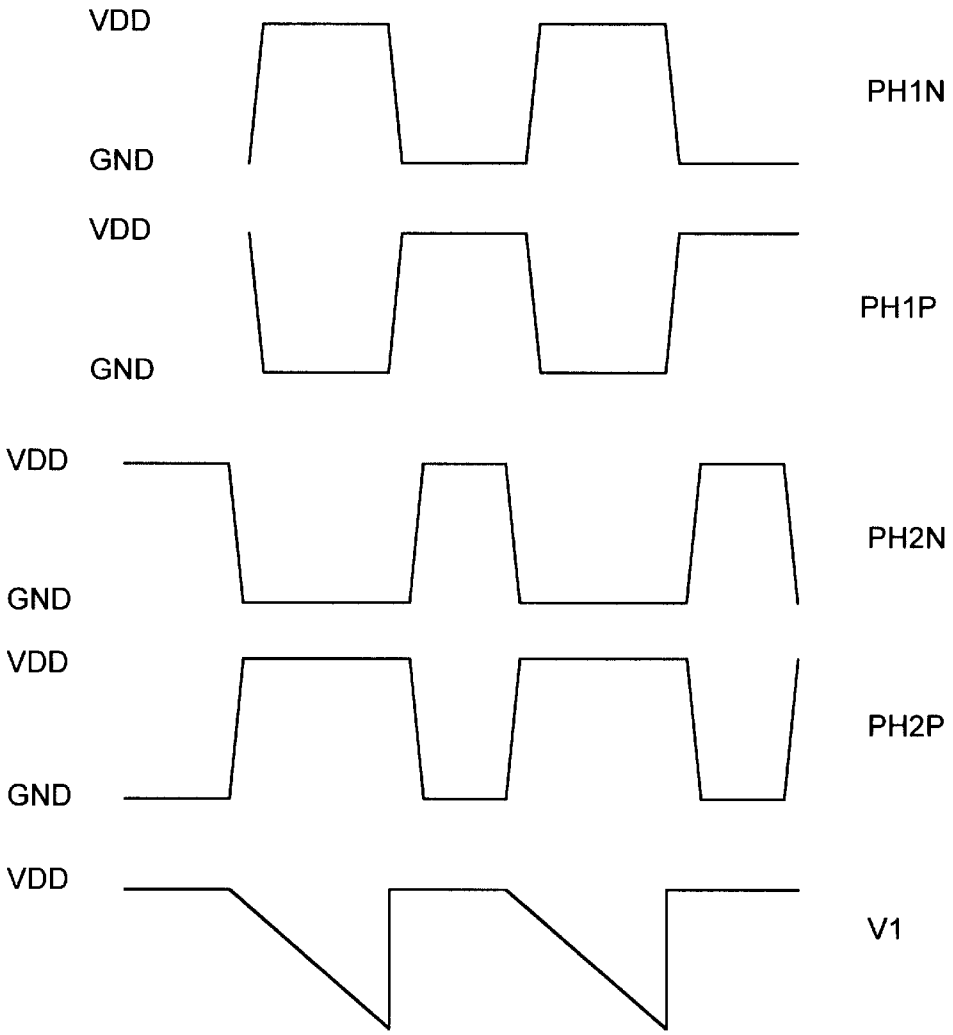
FIG. 3B shows voltage versus time plots of the clock signals PH1N/PH1P, PH2N/PH2P and V1 that control the operation of the bias current generator of FIG. 3A.

Inputs to the bias current source 200 (other than the clock signals ϕ1 and ϕ2) include bias voltages VN1, VN2A, VN2B, and VP1 and the positive supply voltage VDD. The voltages VN1, VN2A, VN2B and VP1 can be generated by inaccurate bias circuits (i.e., the resulting currents of the current mirror do not have to be accurate in the "absolute" sense). To accommodate CMOS switching elements, the clock signals ϕ1 and ϕ2 from FIG. 2A are provided as a pair of signals, PH1N/PH1P and PH2N/PH2P, where the "p" signal is a mirror image or boolean complement of the "n" signal (i.e., the "p" signal is high when the "n" signal is low and vice-versa). In the bias current source 200 the "p" signals are coupled to the gates of p-channel switching transistors (e.g., MP1, MP2, MP3, MP10, MP11) and the "n" signals are coupled to the gates of n-channel switching transistors (e.g., MN6, MN7, MN10 and MN11). Voltage versus time plots of the clock signals PH1N/PH1P, PH2N/PH2P and the voltage V1 are shown in FIG. 3B.

The bias current IOUT, which is the output of the bias current generator 200, is supplied at the drain of the n-channel transistor MN15. The bias current IOUT mirrors and is equal to the current IDM1.

The transistor MP1, capacitors C1, C2, C3, buffer B1, and switches S2 and S3 are connected in the manner shown in FIG. 2A, as are the corresponding components (i.e., the capacitors and switches C5, C6, S4, S5), which are used to define the fully-differential structure. In the preferred embodiment, the capacitor C4 serves as a compensation capacitor as well as the filtering capacitor that holds the gate voltages of the output transistors M1 and MN16 constant. A transconductance reduction technique is applied to limit the bandwidth of the feedback loop to provide filtering and to guarantee feedback loop stability by reducing the transconductance $g_m$ of the operational transconductance amplifier A1. Briefly, this technique entails first selecting pairs of feedback transistors (e.g., the transistors MP7 and MP5) with different sizes. For example, in the preferred embodiment, the p-channel transistors MP7 and MP5 have sizes of 3× and 5×, respectively. The drains of each pair of transistors are coupled to different n-channel feedback transistors, resulting in cross-coupling that reduces the effective transconductance $g_m$ of the amplifier A1. For example, the drains of the transistors MP7 and MP5 are coupled respectively to the drain/gate and drain of the transistors MN8 and MN9, resulting in cross-coupling that effectively reduces the transconductance $g_m$ of the output stages to that provided by a transistor of size 2×. The transistors MP4 and MP6 are sized in the same manner as described for the transistors MP5 and MP7 and are connected respectively to the drain/gate and drain of the current mirror transistors MN8 and MN9, which also serve as the active load of the amplifier A1.

To minimize the errors introduced by the finite output impedance of the bias current generator 200, cascode current sources are used at all critical nodes. The cascode current sources include the n-channel transistor pairs MN15/MN16, MXN10/MXN11, MXN3/MXN4 and M1/MXN2, each of which is connected between the ground node and one of the critical nodes. The cascode current sources are controlled in part by the input signals VN2A, VN2B and VN1. In particular, the gates of the transistors MXN4 and MXN10 are coupled to the signal VN2B; the gates of the transistors MXN2 and the MN15 are coupled to the signal VN2A; the gates of the transistors M1 and MN16 are coupled to the drains of the p-channel transistors MP6 and MP5; and the gates of the transistors MXN3 and MXN11 are coupled to the signal VN1. The signal VN2B biases the cascode transistors MXN4 and MXN10 to boost the output impedance of the corresponding current sources MXN3 and MXN11. The signal VN2A is selected based on the anticipated range of the switching bias current being generated (i.e., the higher the anticipated switching bias current the higher the signal VN2A). Depending on the application of the bias current generator 200 shown in FIG. 3A, the signals VN2A and VN2B can be shorted together. Cascode bias voltages, such as the signal VN2A connected to the transistor MXN2, are selected so they are sufficiently high to ensure that the corresponding current source, such as the transistor M1, is maintained in its active, saturation, high output impedance operating condition. However, the cascode bias voltages should also be low enough to maximize the voltage headroom and dynamic range of the cascode current source.

The bias current IOUT can be estimated as follows:

$$IOUT = IDM1 = \frac{(C1 + Cp)\times(VDD - VREF)}{(Tc12 - td)} \quad \text{Eq. (2)}$$

where Cp is the parasitic capacitance associated with the node N1, Tc is the period of the clock signals PH1N (ϕ1) and PH2N/PH2P (ϕ2), and td is the digital delay time associated with switching of the transistor MP1.

The voltage VREF is generated by forcing a current IR through the impedance Z1. An appropriate choice of IR and Z1 allows the voltage (VDD−VREF) to have various desirable characteristics. A preferred circuit for generating the voltage VREF is shown in FIG. 4A.

Figure 4A:
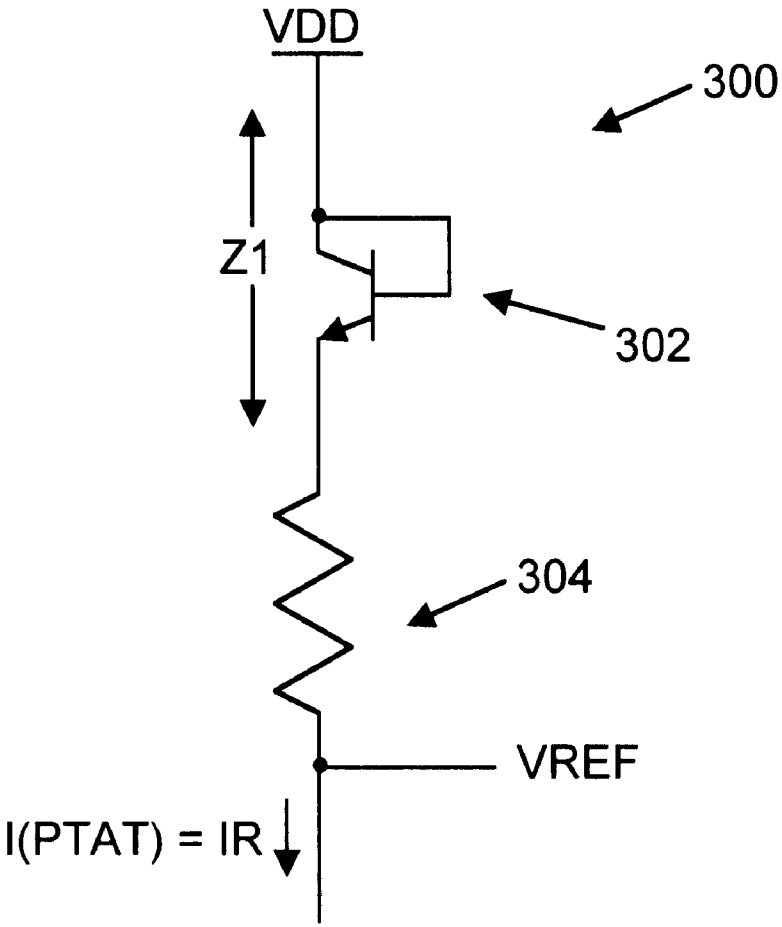
FIG. 4A is a schematic illustrating a circuit used to generate the reference voltage in the bias current generator of FIG. 3A.

Referring to FIG. 4A, there is shown a schematic illustrating a preferred circuit 300 used to generate the reference voltage VREF in the clock-referenced switching bias current generator 200 of FIG. 3A. In this circuit, the impedance Z1 is formed from a bi-polar transistor 302 (such as a parasitic NPN device formed with the substrate being the collector, the well being the base, and the N+ diffusion being the emitter in a P-well CMOS process) with inter-connected base and collector and an emitter coupled to a resistor 304. The voltage (VDD−VREF) can be set equal to a bandgap voltage by choosing IR to be a I(PTAT) (proportional to absolute temperature) current and forming the impedance Z1 as shown. If the voltage (VDD−VREF) is a bandgap voltage, then according to Eq. (1), the bias current IOUT will be a bandgap current with absolute tolerance primarily determined by the value of the capacitor C1. When the dielectric material of the capacitor C1 is the SiO2, which is preferred, its capacitance is typically temperature insensitive, allowing the desired capacitance to be achieved with an absolute tolerance of ±10%. Given the accuracy of the clock signals used as references and this capacitor tolerance, the present invention provides an accurate current bias without the need for any external components.

The bias current generator 200 of the present invention has a number of applications, including in the following types of circuits:

(1) Bandgap bias current generator (as described above);

(2) Anti-process bias current generator;

(3) Process-independent integrator; or (4) Frequency-to-current converter.

As described in reference to FIG. 4A, the present invention can be used as a bandgap bias current generator by setting the voltage (VDD−VREF) equal to a bandgap voltage.

The present invention can be used as an anti-process bias current generator by choosing the reference current IR and the impedance Z1 so that bias current IOUT is larger in value for a "slow" process corner and smaller in value for a "fast" process corner. This enables the tight control of circuit speed and amplifier gain with process variations.

Figure 4B:
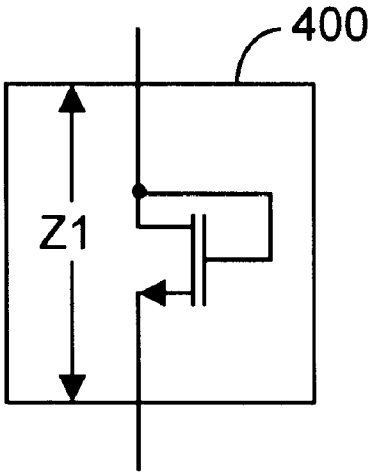
FIG. 4B is a schematic illustrating a single transistor circuit used to implement the impedance Z1 in the bias current generator of FIG. 3A.

For example, the current source IR can be the same as the bias current generated from the bias voltage VN1 while the impedance Z1 can be formed using a circuit with an NMOS transistor, such as the single NMOS transistor circuit 400 shown in FIG. 4B, or various combinations of MOS transistors. Since, for a slow process corner, the transistor(s) used to form the impedance Z1 will have a threshold voltage that tends to be on the high side and a carrier mobility that tends to be on the low side (compared to the nominal process corner), a high gate to source voltage Vgs (corresponding to the voltage VDD−VREF of a single NMOS transistor circuit 400, as shown in FIG. 4B) will result for any given current running through the circuit. This will result in a higher bias current IOUT according to equations Eq. (1) and Eq. (2). A similar analysis applies to a fast process corner except the resulting gate to source voltage Vgs and bias current IOUT will be smaller than for the nominal process corner.

The present invention can also be used as a process-independent integrator. In such an application, a bandgap bias current IOUT generated in accordance with Eq. (1) is applied to an integrator. A preferred embodiment of such an integrator 500 is shown in FIG. 5.

Figure 5:
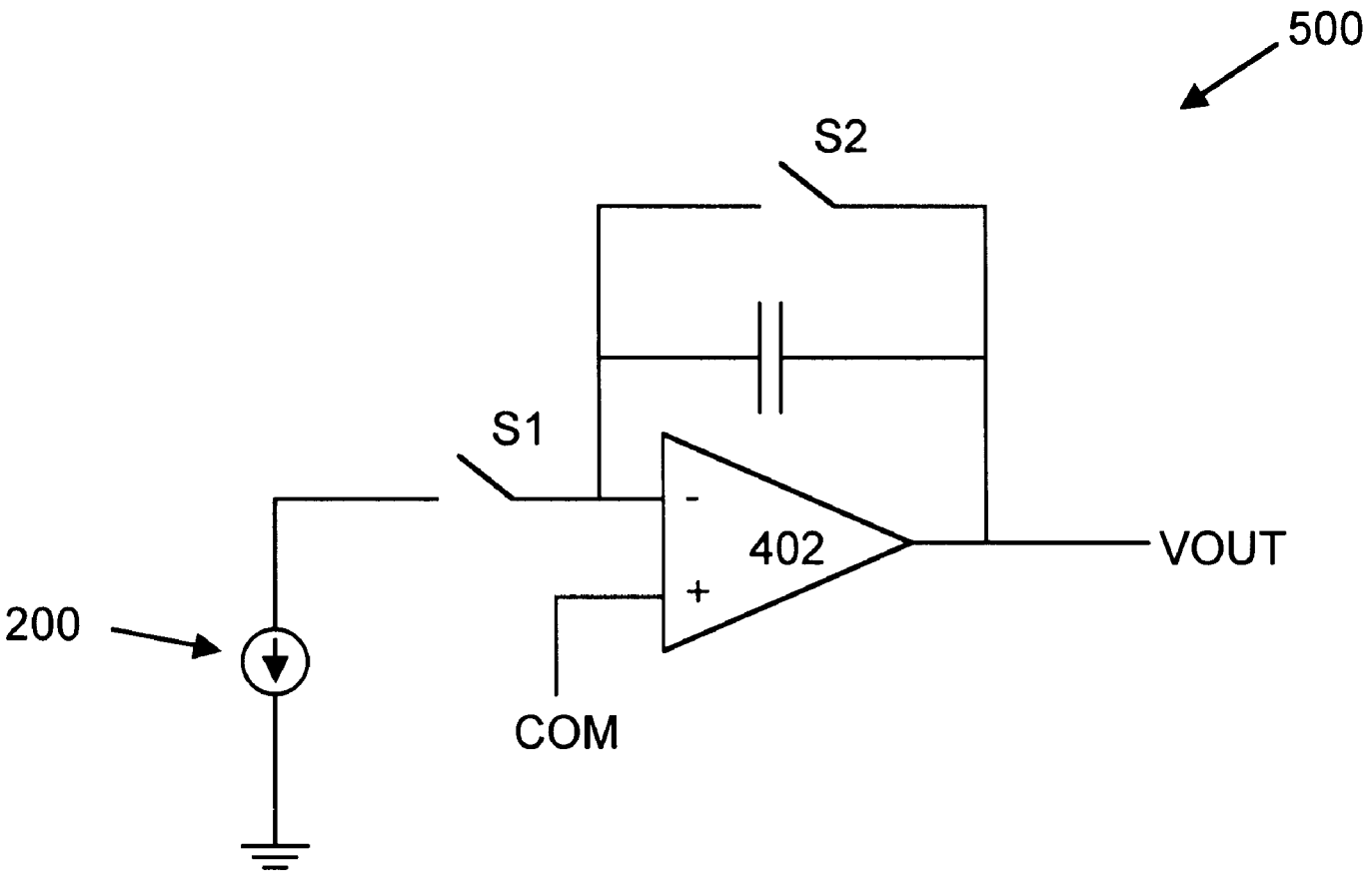
FIG. 5 is a schematic of a process independent integrator that makes use of the bias current generated by the present invention.

Referring to FIG. 5, there is shown the schematic of the integrator 500. It includes an operational amplifier 402 whose inverting input is coupled via a feedback capacitor C1 in parallel with a switch S2 to an output node N5 at which the output voltage VOUT is generated. The inverting input of the amplifier 402 is connected to the bias current generator 200 via a second switch S1. The non-inverting input of the amplifier 402 is coupled to a comparison signal COM. The switches S1 and S2 are of opposite polarity. The integrator 400 can be implemented in any form compatible with the bias current genertor 200 of the present invention.

In this embodiment, applying Eq. (1), the voltage change ΔVOUT in the output voltage VOUT is given by:

$$\Delta VOUT = \frac{2 \times fc \times Cl \times (VDD - VREF)}{Cl} \times T_{integration}, \quad \text{Eq. (3)}$$

where $T_{integration}$ is the time during which the switch S1 is on.

From Eq. (3) it can be seen that the voltage change ΔVOUT depends on the ratio of the capacitances C1 and Cl. Hence, the voltage change ΔVOUT can be made process-independent by using the same type of capacitor for C1 and Cl. The integrator 500 of FIG. 5 has very predictable signal-swing dynamic range characteristics to allow dynamic range optimization. This integrator can be used in applications that use the output signal swing of the integrator for time measurements and dual slope integrating analog to digital converters, etc.

This bias current generator 200 can also be used as a frequency-to-current converter since the generated current is directly proportional to the switching frequency.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A bias current generator for generating a bias current that is a function of a clock frequency and a reference voltage, comprising:

a first switch controlled by a first clock signal having the clock frequency;

a first capacitor connected in parallel with the first switch between a first internal node and a supply voltage node at a supply voltage;

a filter comprising:

a second switch controlled by a second clock signal having the same clock frequency as and non-overlapping with the first clock signal, the second switch having an input and an output coupled respectively to the first internal node and a second internal node;

a second capacitor coupled between the second internal node and the supply voltage node;

a third switch controlled by the first clock signal, the input and output of the second switch being coupled respectively to the second internal node and a third internal node; and a third capacitor coupled between the third internal node and the supply voltage node, the third capacitor holding the voltage at the third internal node constant during one period of the first clock signal;

an amplifier with a first input coupled to the third internal node, a second input coupled to a reference voltage node at the reference voltage, and an output;

a transistor with a gate coupled to the output of the amplifier, a drain coupled to the first internal node and a source coupled to a ground node;

wherein:

when the first clock signal is active, the first capacitor is discharged and the voltage at the first internal node is at the supply voltage;

when the first clock signal is inactive, the voltage at the first internal node ramps down from the supply voltage;

a negative feedback loop including the first capacitor, first switch, transistor and amplifier is formed that controls the gate voltage of and thus the drain current drawn by the transistor, the feedback looping causing the voltage at the first internal node to ramp down from the supply voltage to the reference voltage by the time the first clock signal makes a transition from being inactive to active, the drain current being identical to the bias current;

when the second clock signal makes a transition from being active to inactive, the voltage at the first internal node is sampled by the second capacitor onto the second internal node; and when the first clock signal makes a transition from being inactive to active, the voltage at the second internal node is coupled to the third internal node.

2. The bias current generator of claim 1, further comprising a first buffer with an input coupled to the first internal node and an output coupled to the input of the second switch.

3. The bias current generator of claim 2, wherein the first buffer comprises a transistor having a gate coupled to the first internal node, a source coupled to the input of the filter circuit, and a drain coupled the supply voltage node.

4. The bias current generator of claim 2, further comprising a second buffer, a fourth switch, a fourth capacitor, a fifth switch, and a fifth capacitor coupled together between the reference voltage node and the second input of the amplifier in a corresponding way in which the first buffer, second switch, the second capacitor, the third switch, and the third capacitor are coupled together between the first internal node and the first input of the amplifier.

5. The bias current generator of claim 1, wherein the drain current required to cause the voltage at the first internal node to ramp down from the supply voltage to the reference voltage during the active period of the first clock signal is given by the following expression:

$$IDM1=IOUT=(2fc)(C1)(VDD-VREF),$$

where IOUT represents the bias current established by the current generator, IDM1 represents the drain current fc represents the clock frequency C1 represents the capacitance of the first capacitor, VDD represents the supply voltage, and VREF represents the reference voltage.

6. The bias current generator of claim 1, further comprising:

an impedance coupled between the supply and reference voltage; and a reference current source coupled between the supply voltage and ground nodes to force a reference current through the impedance circuit so that a voltage equal to the difference between the supply and reference voltages is provided across the impedance;

wherein the current generator is implemented in a monolithic integrated circuit without the need for external components.

7. The bias current generator of claim 6, wherein:

the bias current generator comprises a bandgap bias current generator; and the impedance comprises a MOS transistor with a gate and a drain shorted together and coupled to the supply voltage node and with a source coupled to the reference voltage node.

8. The bias current generator of claim 6, wherein:

the bias current generator comprises an anti-process bias current generator:

the impedance circuit comprises:

a bipolar junction transistor with an emitter, a collector, and a base, the collector and base being interconnected and coupled to the supply voltage node; and a resistor with one end coupled to the emitter of the bipolar junction transistor and another end coupled to the reference voltage node; wherein the reference current is proportional to absolute temperature.

9. The bias current generator of claim 1, further comprising a fourth switch, a fourth capacitor, a fifth switch, and a fifth capacitor coupled together between the reference voltage node and the second input of the amplifier in a corresponding way in which the second switch, the second capacitor, the third switch, and the third capacitor are coupled together between the first internal node and the first input of the amplifier.

10. The bias current generator of claim 1, wherein the amplifier includes a first feedback pair of CMOS transistors coupled to the first input of the amplifier and a second feedback pair of CMOS transistors coupled to the second input of the amplifier, the amplifier being configured so that a first transistor of the first feedback pair and a first transistor of the second feedback pair comprise a first differential pair and a second transistor of the first feedback pair and a second transistor of the second feedback pair comprise a second differential pair, the amplifier being further configured so that the transconductance of each of the first and second feedback pairs equals the transconductance that would be achieved using a single CMOS transistor whose size is the difference of the sizes of the transistors of the feedback pair.

11. The bias current generator of claim 10, further comprising a capacitor coupled between the output of the amplifier and the ground node.

12. The bias current generator of claim 10, wherein:

the amplifier further comprises:

a first current mirror pair of p-channel CMOS transistors each having a gate, a drain, and a source;

a second current mirror pair of n-channel CMOS transistors each having a gate, a drain, and a source;

the transistors of the first and second feedback pairs comprise p-channel CMOS transistors each having a gate, a drain, and a source;

the sources of the transistors of the first current mirror pair are coupled to the supply voltage node;

the gates of the transistors of the first current mirror pair are controlled by a control voltage;

the gates of the transistors of the first feedback pair are coupled together and to the first input of the amplifier;

the gates of the transistors of the second feedback pair are coupled together and to the second input of the amplifier;

the sources of the first transistors of the first and second feedback pairs are coupled together and coupled to the supply voltage node by a first transistor of the first current mirror pair;

the sources of the second transistors of the first and second feedback pairs are coupled together and coupled to the supply voltage node by a second transistor of the first current mirror pair;

the drains of the first and second transistors of the first and second feedback pairs, respectively, are coupled together and to the gates of the second current mirror pair and the drain of the first transistor of the second current mirror pair;

the drains of the second and first transistors of the first and second feedback pairs, respectively, are coupled together and to the drain of the second transistor of the second current mirror pair and the output of the amplifier; and the sources of the transistors of the second current mirror pair are coupled to the ground node.

13. The bias current generator of claim 1, wherein the bias current generator comprises a frequency-to-current converter.

14. The bias current generator of claim 1, wherein the bias current generator is configured for use in a process-independent integrator.

15. A bias current generator for generating a bias current that is a function of a clock frequency and a reference voltage, comprising:

a first switch controlled by a first clock signal having the clock frequency;

a first capacitor connected in parallel with the first switch between a first internal node and a supply voltage node;

an amplifier with a first input coupled to the first internal node, a second input coupled to a reference voltage node at the reference voltage, and an output;

a transistor with a gate coupled to the output of the amplifier, a drain coupled to the first internal node and a source coupled to a ground node;

wherein:

when the first clock signal is active, the first capacitor is discharged and the voltage at the first internal node is at a supply voltage; and when the first clock signal is inactive, the voltage at the first internal node ramps down from the supply voltage;

a negative feedback loop including the first capacitor, first switch, transistor and amplifier is formed that controls the gate voltage of and thus the drain current drawn by the transistor, the feedback loop causing the voltage at the first node to ramp down from the supply voltage to the reference voltage by the time the first clock signal makes a transition from being inactive to active, the drain current being identical to the bias current; and the amplifier includes:

a first feedback pair of p-channel CMOS transistors each having a gate, a drain, and a source;

a second feedback pair of p-channel CMOS transistors each having a gate, a drain and a source;

a first current mirror pair of p-channel CMOS transistors each having a gate, a drain, and a source;

a second current mirror pair of n-channel CMOS transistors each having a gate, a drain, and a source;

the sources of the transistors of the first current mirror pair are coupled to the supply voltage node;

the gates of the transistors of the first current mirror pair are controlled by a control voltage;

the gates of the transistors of the first feedback pair are coupled together and to the first input of the amplifier;

the gates of the transistors of the second feedback pair are coupled together and to the second input of the amplifier;

the sources of respective first transistors of the first and second feedback pairs are coupled together and coupled to the supply voltage node by a first transistor of the first current mirror pair;

the sources of respective second transistors of the first and second feedback pairs are coupled together and coupled to the supply voltage node by a second transistor of the first current mirror pair;

the drains of the first and second transistors of the first and second feedback pairs, respectively, are coupled together and to the gates of the second current mirror pair and the drain of the first transistor of the second current mirror pair;

the drains of the second and first transistors of the first and second feedback pairs, respectively, are coupled together and to the drain of the second transistor of the second current mirror pair and the output of the amplifier;

the sources of the transistors of the second current mirror pair are coupled to the ground node;

wherein the amplifier is configured so that the first transistors of the first and second feedback pairs comprise a first differential pair and the second transistors of the first and second feedback pairs comprise a second differential pair, and wherein the amplifier is further configured so that the transconductance of each of the first and second feedback pairs equals the transconductance that would be achieved using a single CMOS transistor whose size is the difference of the sizes of the transistors of the feedback pair.

16. The bias current generator of claim 15, further comprising a capacitor coupled between the output of the amplifier and the ground node.

* * * * *